US005649483A

United States Patent [19]

Mack et al.

[11] Patent Number: 5,649,483

[45] Date of Patent: Jul. 22, 1997

[54] DEVICE FOR THE AUTOMATIC SINGLING-OUT OF SHEETS IN THE DELIVERY OF A SHEET-FED ROTARY PRINTING PRESS

[75] Inventors: Richard Mack, Brühl; Udo Lautenklos, Waldmichelbach; Rainer Klenk, St. Leon-Rot; Roland Hirth, Römerberg, all of Germany

[73] Assignee: Heidelberger Druckmaschinen AG, Heidelberg, Germany

[21] Appl. No.: 654,081

[22] Filed: May 28, 1996

[30] Foreign Application Priority Data

May 26, 1995 [DE] Germany ..... 195 19 374.1

[51] Int. Cl.[6] ..... B41F 13/24

[52] U.S. Cl. ..... 101/232; 271/197; 271/277; 271/204; 271/300

[58] Field of Search ..... 101/232, 233, 101/234, 216; 271/204, 207, 197, 183, 277, 300

[56] References Cited

U.S. PATENT DOCUMENTS

| | | | |
|---|---|---|---|
| 4,799,664 | 1/1989 | Burger | 271/277 |
| 4,830,355 | 5/1989 | Jeschke | 271/183 |
| 5,259,608 | 11/1993 | Pollich | 271/183 |
| 5,329,852 | 7/1994 | Bolza-Schuenemann et al. | 101/232 |
| 5,348,285 | 9/1994 | Hüser | 271/197 |
| 5,390,911 | 2/1995 | Schmid | 271/197 |

OTHER PUBLICATIONS

Japanese Petty Patent No. 5–027388, dated Jul. 17, 1986.

Japanese Petty Patent No. 61–112927, dated Jul. 17, 1986.

*Primary Examiner*—Eugene H. Eickholt

*Attorney, Agent, or Firm*—Herbert L. Lerner; Laurence A. Greenberg

[57] ABSTRACT

Individual sheets are singled out in a delivery of a sheet-fed rotary printing press. The delivery has a chain delivery with gripper bars extending transversely to the sheet-transport direction. The gripper bars are disposed on revolvingly driven transport chains and carry spaced apart sheet grippers disposed side by side. The sheet grippers grip the leading edges of the sheets and slave them to a main sheet pile. The gripper release is subject to an adjustable control for delayed sheet release, so that selected sheets may be transported beyond the main sheet pile. Revolvingly drivable suction tapes suction-grip the sheets which are released by the grippers with the delay, and they transport those sheets in the transport direction across and beyond the main sheet pile and onto a single sheet depository. The sheet depository is movably disposed in or on the printing-press frame. The suction tapes have upper suction surfaces at a raised position which extend between the sheet grippers. The grippers delay the sheet release until at least a leading region of the respective sheet is located above the suction tapes.

16 Claims, 5 Drawing Sheets

Fig.5
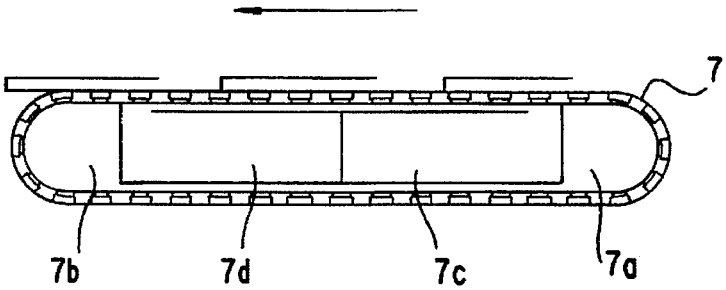
Fig.6
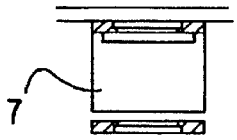
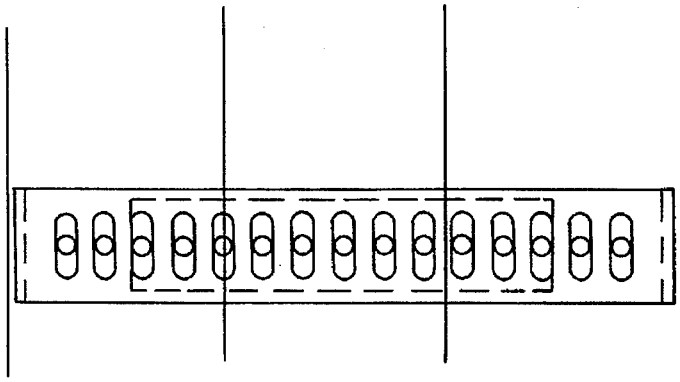
Fig.7
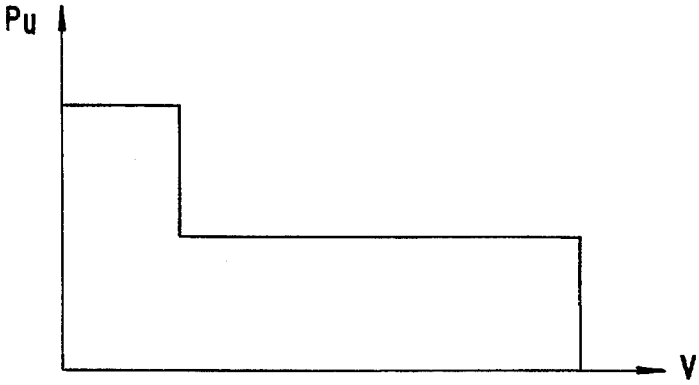
Fig.9
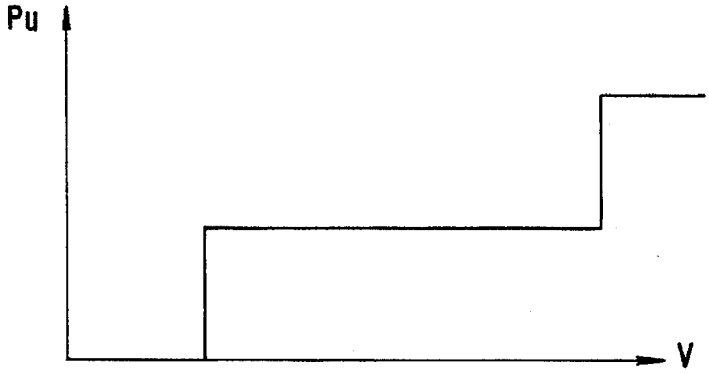
Fig.8

DEVICE FOR THE AUTOMATIC SINGLING-OUT OF SHEETS IN THE DELIVERY OF A SHEET-FED ROTARY PRINTING PRESS

BACKGROUND OF THE INVENTION

1. Field of the Invention

The invention relates to a device for the automatic singling-out of sheets in the delivery of a sheet-fed rotary printing press. The device pertains to single-sheet delivery in the delivery of a sheet-fed rotary printing press with a chain delivery, in which gripper bars extending transversely to the sheet-transport direction are disposed on revolvingly driven transport chains and laterally spaced-apart sheet grippers are disposed on the gripper bars; the sheet grippers grip the sheets consecutively by their front edges; the delivery further comprises an adjustable control for delayed sheet release, consisting of revolvingly driven suction tapes supplied with suction air; the suction tapes grip the delayed-released sheet with suction and transport the sheet in the sheet-transport direction across a main sheet pile onto a sheet depository movably disposed on the printing-press frame.

2. Description of the Related Art

A device comprising such features is known from Japanese patent publication JP-Sho 61-112927. The device described therein permits the singling-out of individual printed sheets, particularly proofing sheets, and the delivery thereof at the rear end face of the delivery (in the sheet-transport direction). In order to single-out individual sheets, by means of an automatic control, the sheet grippers (holding a sheet at its front edge) of a gripper system of a chain delivery are opened in a delayed manner with respect to the instant of opening for sheet delivery on the main pile. The delayed opening is accomplished through the adjustment of the gripper-opening cam. At the same time, any existing stops for the sheet front edge on the main pile are lowered, for example through swiveling, with the result that the delayed-released sheet is gripped by revolvingly driven suction tape and is transported across the main pile onto the single-sheet depository. A similar device is also described in Japanese utility model publication Hei 5-27388.

It has become known heretofore from European patent publication EP-A 0 180 827 that, after the singling-out of an individual sheet, the actuators (operated for the singling-out of the individual sheet), the transport means, and the sheet stops of the main pile automatically reset to a zero position or are switched off. In an effort to deposit single sheets, there is provided in the system according to the above-mentioned JP-Sho 61-112927, a rake-like sheet depository, swivellable about a transverse shaft. The rake-like depository is disposed at the (in the sheet-transport direction) rear end face of the delivery, with the result that the sheet depository can be swivelled upwardly into an approximately vertical position so that it does not constitute an obstruction during production printing and does not unnecessarily impede the view into the printing press. The same publication also discloses a rake-like sheet depository, telescopically variable in the sheet-transport direction, for adaptation to different sheet sizes. Consequently, the singling-out of individual sheets necessitates extensive manual preparation before the system can operate automatically. The structurally very elaborate and complicated frame used as the sheet depository impedes the view of the operator also when it is in the raised position and it is rather easily exposed to damage.

SUMMARY OF THE INVENTION

It is accordingly an object of the invention to provide a device for the automatic singling-out of sheets in the delivery of a sheet-fed rotary printing press, which overcomes the above-mentioned disadvantages of the heretofore-known devices and methods of this general type and which is simple and as operationally reliable as possible; in particular, the device should be suitable for high-speed printing presses and its automatic sequence of movements should be safely and reliably incorporatable into the working cycle of the delivery.

With the foregoing and other objects in view there is provided, in accordance with the invention, a delivery in a sheet-fed rotary printing machine for depositing sheets to a main sheet pile and, selectively, for singling-out individual sheets to a single-sheet delivery, comprising:

a chain delivery with revolvingly driven transport chains, a plurality of mutually spaced-apart gripper bars driven by the transport chains, the gripper bars extending transversely to a sheet transport direction, and mutually spaced apart sheet grippers disposed on gripper bars for gripping consecutively arriving sheets by a leading edge thereof and transporting the sheets onto a main sheet pile;

a sheet depository for receiving singled-out sheets;

a revolvingly drivable suction tape disposed between the main sheet pile and the sheet depository, the suction tape being subjectable to suction air, and having an upper suction surface extending between the grippers; and an adjustable control operatively associated with the grippers for selectively releasing sheets in a delayed manner above the upper suction surface extending between the grippers, such that the suction tape suction-grips the sheets which have been released in the delayed manner and transports the sheets in the sheet-transport direction beyond the main sheet pile and onto the sheet depository;

In accordance with an added feature of the invention, the suction tape is divided into individual sections, and the suction air is supplyable separately section by section in the sheet-transport direction. This ensures that the suction tapes still suction-grip the sheet in its rear region when the front region of the suction tapes has already had the suction air switched off.

In accordance with an additional feature of the invention, the printing press has a printing press frame and the sheet depository is stored in the printing press frame, the sheet despository having a substantially closed depository base and being withdrawable out of the printing press frame in the sheet-transport direction. In other words, the sheet depository for single sheets or for several single sheets is withdrawable out of the printing-press frame in the sheet-transport direction and comprises an essentially closed depository base. This has the advantage that, during production printing without single-sheet removal, the single-sheet depository can be advantageously moved into a non-disrupting rest position inside the printing-press frame. Conversely the essentially closed depository bottom allows blast-air to be blown underneath the sheet, wherein blast-air preferably escapes from nozzles in the sheet-transport direction and serves to guide, tauten and/or brake the sheet.

In accordance with another feature of the invention, there are provided a plurality of blast-air nozzles disposed in the vicinity of the suction tapes for blowing blast-air underneath singly deposited sheets. Blast-air nozzles may be disposed at the sheet depository for tautening and/or braking sheets in the sheet depository.

In accordance with a further feature of the invention, there are provided fixed suction chambers disposed beneath the upper suction surface of the suction tape, and the suction tapes being perforated suction tapes guided over the fixed suction chambers, the chambers being upwardly open and being adapted to be supplied individually in the sheet-transport direction.

In accordance with again an added feature of the invention, the depository base is a roll-up-type bottom being withdrawable from and stowable inside the printing-press frame. Preferably, there is provided a grippable grip strip formed on a front edge of the withdrawable sheet depository. The withdrawable sheet depository is formed of transparent material, thus allowing better visual access into the delivery.

In accordance with a further feature of the invention, the roll-up-type depository base of the sheet depository is spring-biased in a rolled-up stowing position, and the base is unrollable and withdrawable against the action of a spring from the printing-press frame.

In the alternative, the sheet depository is formed with a plurality of telescopically retractable and extendable sections.

In accordance with again another feature of the invention, there is provided a programmable electronic control for automatic single-sheet removal, the electronic control being operatively connected to effect a delayed sheet release by the grippers, to govern driving elements for withdrawing the sheet depository, and the electronic control controlling means for driving and for timing a supply of suction air to the suction tapes.

The suction tape is preferably a plurality of parallel, mutually spaced-apart suction tapes, the suction tapes receiving the sheets to be singled out from the grippers, accelerating the sheets, and subsequently decelerating the sheets over an extended distance towards the sheet depository.

In accordance with a concomitant feature of the invention, a suction-tape drive with a drive control drives the suction tapes; the control accelerates the suction tapes up to a point when the sheet to be singled out is transferred from the grippers to the tapes, subsequently accelerates the suction tapes beyond the point of sheet transfer, and initiates braking only after a delay.

The invention permits safe and reliable singling-out of an individual sheet or also of several individual sheets one after the other, this being done irrespective of speed. There is no need for skill on the part of the printing-press operator. Damage to the singled-out sheets, furthermore, is largely avoided. The singling-out of individual sheets can be preset manually or by a suitable control and then take place automatically. Consequently, the device of the invention is particularly suited for automatically removing proof sheets in high-speed sheet-fed rotary printing presses. The view into the delivery during production printing is not impeded by components of the device for single-sheet removal. The device is suitable both for the singling-out and deposition of individual sheets or of a plurality of single sheets one after the other and it is thus suitable for accepting a small quantity of discards.

The novel device according to the invention ensures that individual sheets that are to be singled out are safely brought by their leading edges up to the suction tapes and are firmly held by the latter when the sheet grippers open with a delay and release the sheet after it has been transported beyond the main pile by its leading edge.

Other features which are considered as characteristic for the invention are set forth in the appended claims.

Although the invention is illustrated and described herein as embodied in a device for the automatic singling-out of sheets in the delivery of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing figures.

BRIEF DESCRIPTION OF THE DRAWINGS

FIG. 5 is a section taken along a line V—V in FIG. 3;

FIG. 6 is a cross sectional view of a suction tape according to FIG. 5;

FIG. 7 is a top plan view of the suction tape of FIG. 5;

FIGS. 8 and 9 are two different diagrams for the control of the vacuum of a suction tape adapted to be sectionally supplied with suction air.

DESCRIPTION OF THE PREFERRED EMBODIMENTS

Figure 1:
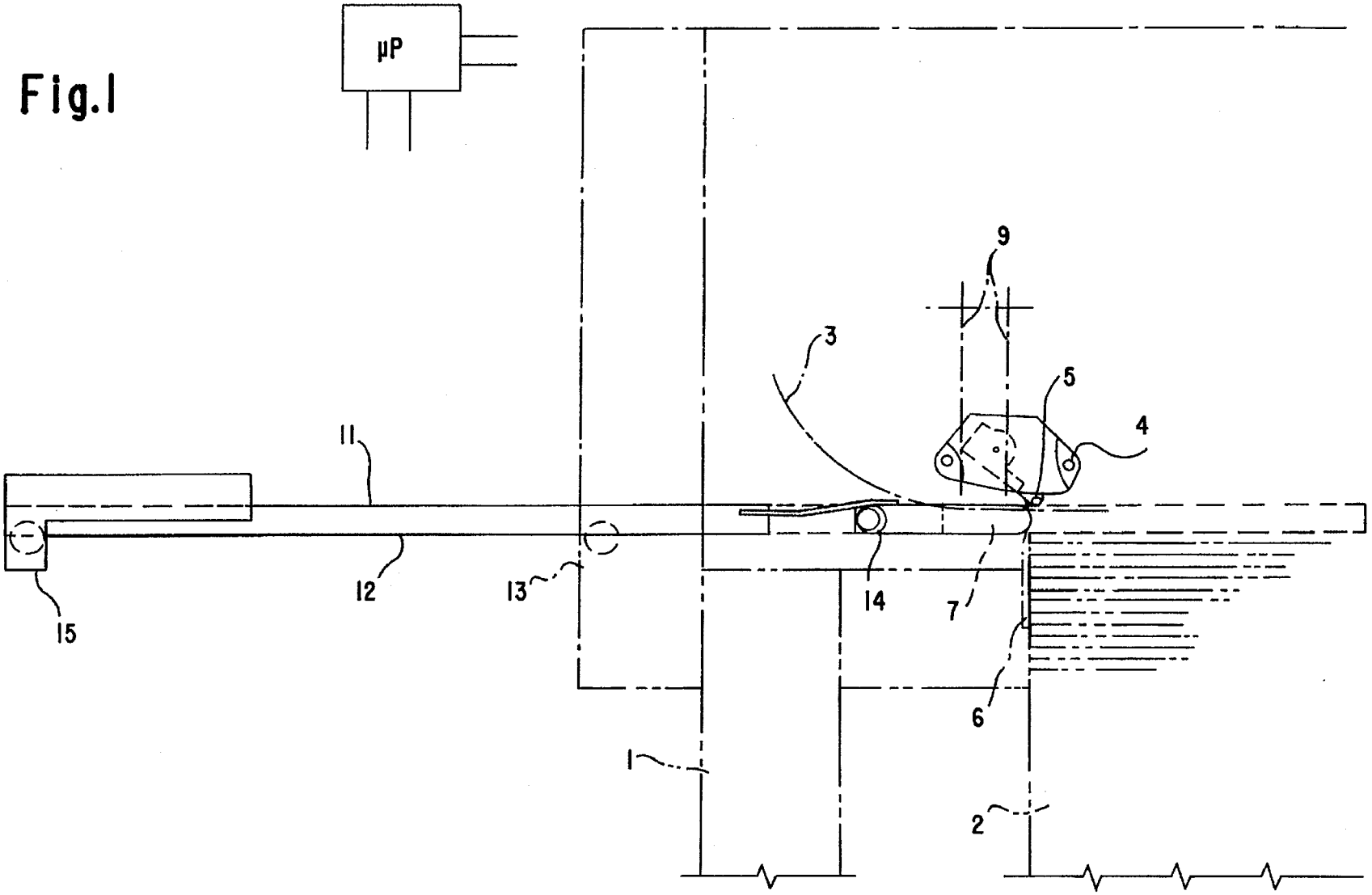
FIG. 1 is a side elevational view of a device for single-sheet removal at the delivery of a sheet-fed rotary printing press.

Referring now to the figures of the drawing in detail and first, particularly, to FIG. 1 thereof, there is seen a main sheet pile 2 being formed in the printing-press frame 1 of the delivery of a sheet-fed rotary printing press. The sheets are transported by a chain conveyor consisting of two parallel, endlessly revolving transport chains 3, one of which is indicated in FIG. 1 by the dash-dotted line. Gripper systems are disposed on the transport chains 3 at intervals. The spaced apart gripper systems each comprise a gripper bar 4, extending transversely across the sheet width between the transport chains 3, and, thereon, mutually spaced apart sheet grippers 5 disposed side by side. The sheet grippers 5 are conventional grippers with gripper fingers, movably held on the gripper bar 4, and a gripper pad, fixed on the gripper bar 4. A gripper-opening cam is used to control the movement of the gripper fingers for opening and closing the sheet gripper. The gripper-opening cam is not shown in the drawing for reasons of clarity. The gripper-opening cam opens the sheet grippers 5 on the gripper bars 4 at a predetermined point in time, with the result that the sheets, being transported from a preceeding printing unit to the main pile 2 in the delivery, are released and are lowered onto the main pile 2. The formation of a straight-edged main pile is ensured by stops 6 for the leading edge of the sheet. The stops are movable in order to allow individual sheets to be singled out, manually or automatically, beyond the main pile 2 in the sheet-transport direction.

Figure 3:
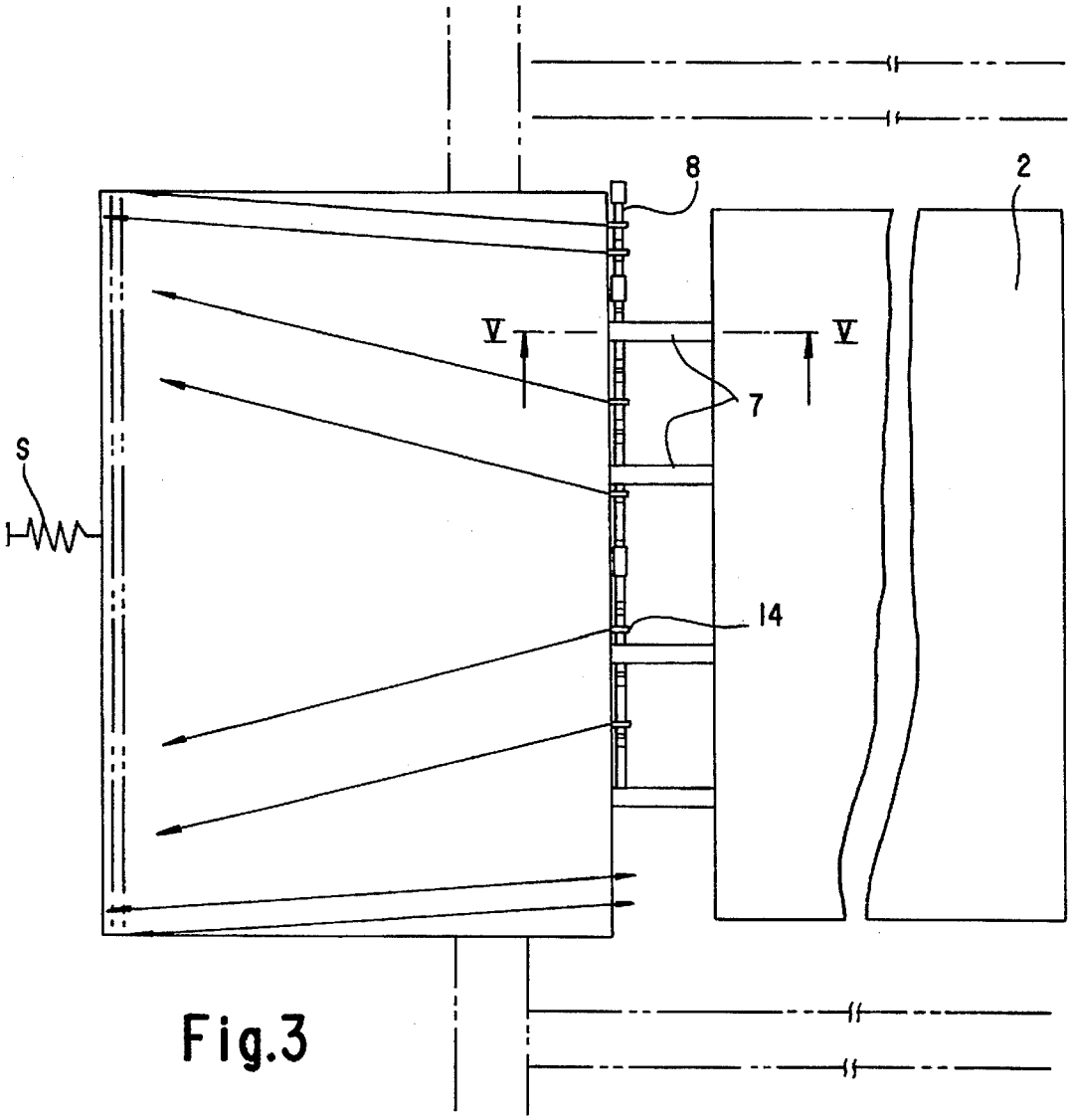
FIG. 3 is a top view of the device for single-sheet removal according to FIG. 1.

The device for single-sheet removal comprises, firstly, a system for delayed gripper opening, so that, with front-edge stops 6 retracted or swung out of the way, the single sheet to be removed can be forwarded to transport means which effect the further transport of that single sheet. Suction tapes 7 are provided for this purpose at a plurality of locations between the sheet grippers 5. The suction tapes 7 are disposed with their top sides (suction-gripping the sheet) in a raised position between the sheet grippers (FIG. 3). The suction tapes 7 are driven by a common drive shaft 8. The raised arrangement of the top sides (suction-gripping the sheet) of the suction tapes ensures that, when the sheet to be singled out is released with a delay by the sheet grippers 5, the sheet is brought into alignment with the front region of the suction tapes (in the sheet-transport direction). The result is that the sheet is reliably suction-gripped by the suction air of the suction tapes when the delayed release of the sheet is effected by the sheet grippers.

The delayed release and the partial alignment of the front sheet region (leading portion of the sheet) with the front region of the suction tapes is shown by the dash-dotted lines 9, which illustrates the required overlap.

The supply of suction air to the suction tapes is effected seperately—section by section in the sheet-transport direction. This ensures that the sheet 10 is suction-gripped over the entire length of its contact with the suction tapes, even when partial regions of the suction tapes have already had the suction air switched off. This is accomplished by conventional means in which perforated tapes are guided over fixed chambers *7a* to *7d*. The chambers *7a* to *7d* are upwardly open and are adapted to be supplied individually with suction air in the sheet-transport direction. The graph in FIG. 8 (which illustrates the scution air distribution) shows that the incoming sheet 10 is suction-gripped first of all in the region of the chamber *7a*, then also in the region of the chambers *7c* and *7d* and, finally, only in the region of the chamber *7b*. If only one sheet is being singled or separated out, the suction tape used for sheet transport can be accelerated slowly to sheet-transport speed before it effects the transport of the sheet that is to be singled out and is thereafter decelerated with the suction-gripper sheet in order, finally, to deposit the sheet without danger of damage on the sheet depository 11. If a plurality of sheets are being singled out one after the other, this sequence of movements takes place within a single cycle.

Figure 10:
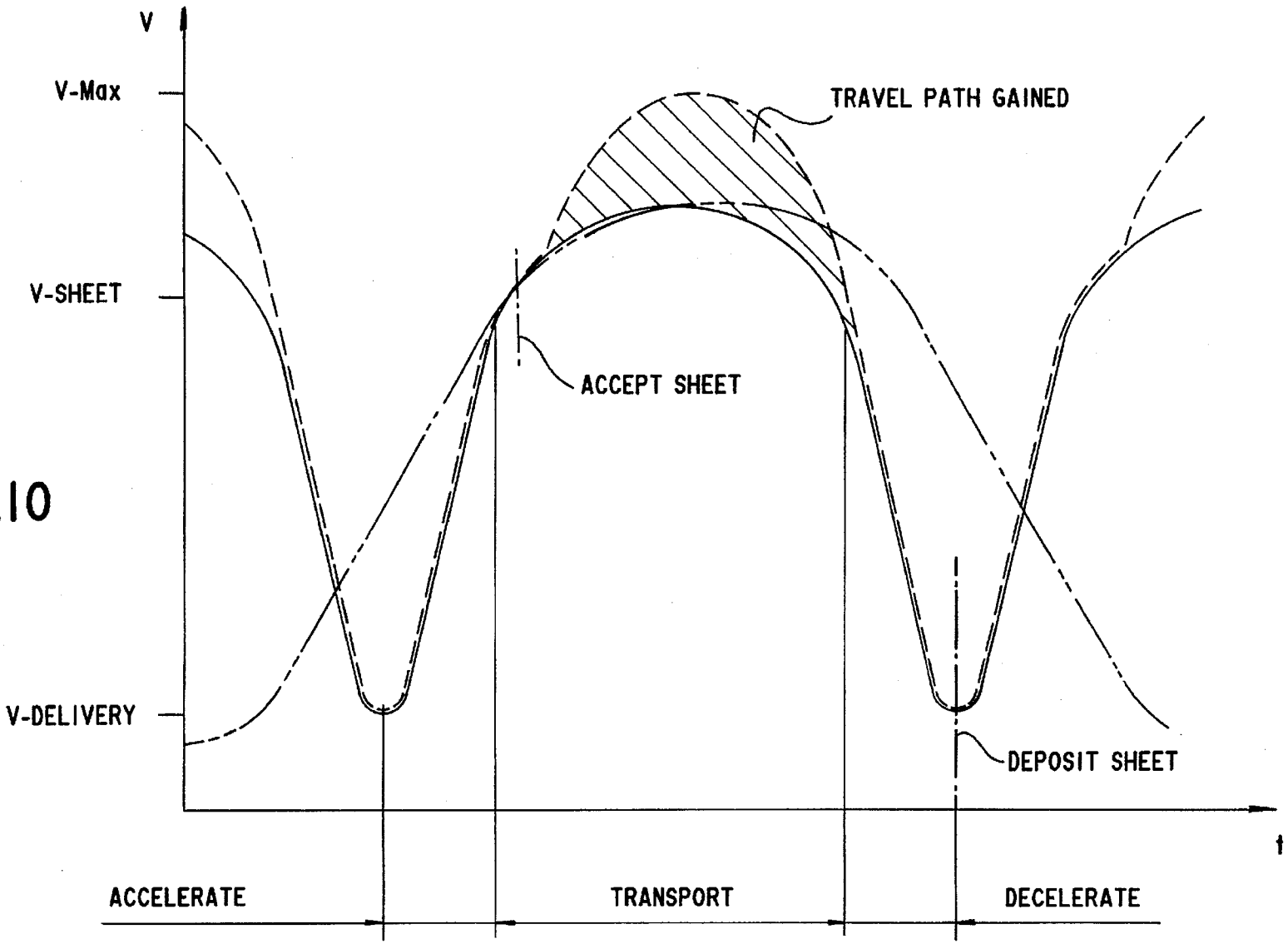
FIG. 10 is a graph illustrating the speed control of the the suction tape according to the invention.

It is also possible to single out several sheets, one after the other. A special such embodiment of the invention provides that, as a result of a higher rotational speed of the suction tape, the sheet in the transport region undergoes an additional acceleration before deceleration takes place. This results in a gain in time and, consequently, a gain in travel path distance between two consecutive sheets, as is graphically represented in FIG. 10.

Figure 2:
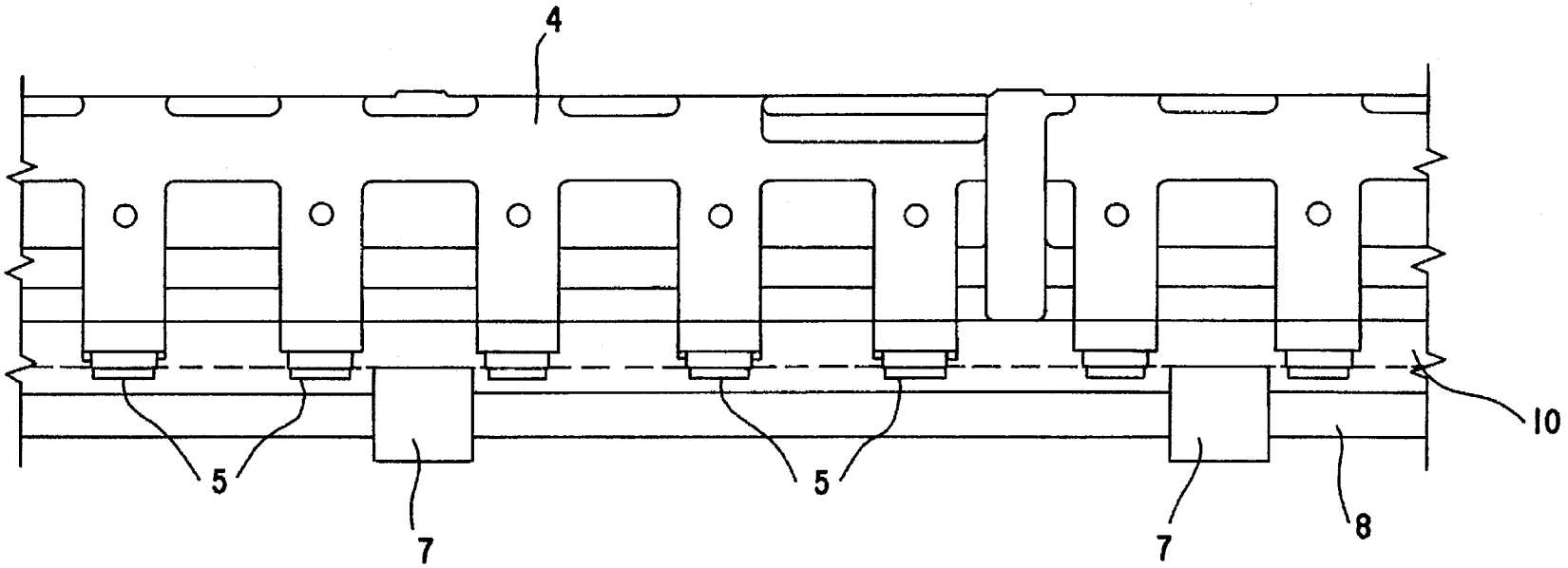
FIG. 2 is a partial top view (enlarged in scale with respect to FIG. 1) of a gripper system formed with a gripper bar and several sheet grippers.
Figure 4:
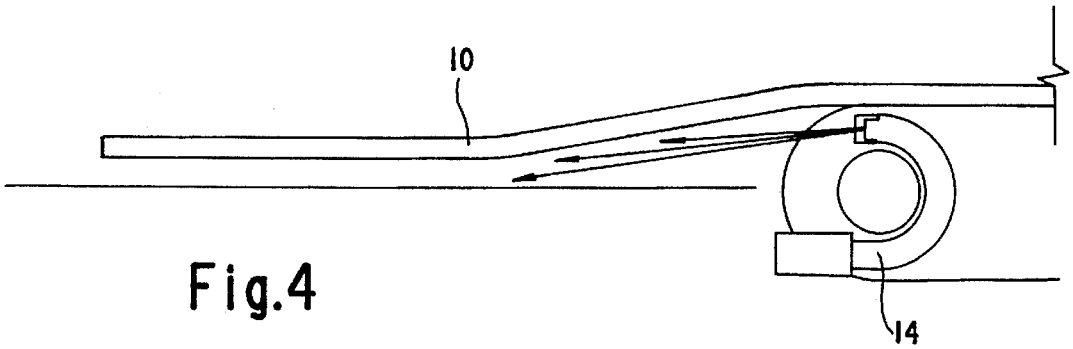
FIG. 4 is a side elevational view of a blast-air nozzle for blowing underneath the individual sheet that is to be singled out.

The sheet or plurality of sheets singled out in this manner are deposited onto a sheet depository 11. The sheet depository 11, which can be withdrawn out of the printing-press frame 1 in the sheet-transport direction, has an essentially closed depository base 12 (FIGS. 1 and 2). Preferably, the sheet depository 11 can be rolled up with its depository base 12; in other words, the sheet depository 11 should be formed of a material suitable for this purpose. This allows the sheet depository 11 to be retracted and stowed in a stowage space 13 inside the printing-press frame 1. The sheet depository 11 can be withdrawn out of the stowage space 13, for example against the action of a spring, into the in-use position shown in FIG. 1. The spring function is diagrammatically illustrated in FIG. 3 at the reference S. When it is not in use, the sheet depository 11 is retracted into the stowage space 13 by the spring action. In a different embodiment, the sheet depository 11 is dividided into individual telecopic sections. The individual sections can thereby telescope into one another for storage in the stowage space on or in the printing-press frame. The essentially closed bottom of the sheet depository 11 allows blast-air to be blown underneath the sheet 10 as it is transported by the suction tapes 7 onto the depository base 12. Blast-air nozzles 14 are provided for this purpose which act as stretching nozzles. The blast-air nozzles 14 are thereby disposed between the suction tapes 7 and, where appropriate, also outside of the outer suction tapes 7 approximately at the level of the (in the sheet-transport direction) rear reversal point of the suction tapes 7 and being positioned diagonally outwards in their direction of action. The blast-air nozzles acting in the sheet-transport direction allow extensively contact-free sheet guiding in the region of the sheet depository 11 and, given an appropriate configuration, may also be used for sheet tautening and/or sheet braking. The withdrawal of the sheet depository 11 and its retraction into the stowage space 13 is facilitated by a grippable grip strip 15 or similar which, at the same time, stabilizes the single-sheet depository 11 in the transverse direction. The stowage space for a roll-up-type single-sheet depository 11 may also be provided inside the grip strip 15, with the result that the single-sheet depository 11 unrolls out of the grip strip when it is withdrawn. In particular, if a single-sheet depository is manufactured from a flexible, windable material, this also permits manufacture from a transparent material with an improved view into the delivery when the single-sheet depository 11 is withdrawn.

The automatic single-sheet removal may be regulated and controlled with a programmable electronic control (μP—schematically illustrated in FIG. 1), possibly integrated into the main printing press control. The electronic control thereby controls the actuators for delayed sheet release by the sheet grippers 5, the driving elements for the withdrawal of the single-sheet depository 11, and control means both for the driving of and also for the timed supply of suction air to the suction tapes 7.

We claim:

1. A delivery in a sheet-fed rotary printing machine for depositing sheets to a main sheet pile and, selectively, for singling-out individual sheets to a single-sheet delivery, comprising:

a chain delivery with revolvingly driven transport chains, a plurality of mutually spaced-apart gripper bars driven by said transport chains, said gripper bars extending transversely to a sheet transport direction, and mutually spaced apart sheet grippers disposed on gripper bars for gripping consecutively arriving sheets by a leading edge thereof and transporting the sheets onto a main sheet pile;

a sheet depository for receiving singled-out sheets;

a revolvingly drivable suction tape disposed between the main sheet pile and said sheet depository, said suction tape being subjectable to suction air, and having an upper suction surface extending between said grippers; and an adjustable control operatively associated with said grippers for selectively releasing sheets in a delayed manner above said upper suction surface extending between said grippers, such that said suction tape suction-grips the sheets which have been released in the delayed manner and transports the sheets in the sheet-transport direction beyond the main sheet pile and onto said sheet depository.

2. The device according to claim 1, wherein said suction tape is divided into individual sections, and the suction air is supplyable separately section by section in the sheet-transport direction.

3. The device according to claim 1, wherein the printing machine has a printing press frame and said sheet depository is stored in the printing press frame, said sheet despository having a substantially closed depository base and being withdrawable out of the printing press frame in the sheet-transport direction.

4. The device according to claim 1, which further comprises a plurality of blast-air nozzles disposed in the vicinity of said suction tapes for blowing blast-air underneath singly deposited sheets.

5. The device according to claim 1, which further comprises fixed suction chambers disposed beneath said upper suction surface of said suction tape, and said suction tapes being perforated suction tapes guided over said fixed suction chambers, said chambers being upwardly open and being adapted to be supplied individually in the sheet-transport direction.

6. The device according to claim 3, wherein said depository base is a roll-up-type bottom being withdrawable from and stowable inside the printing-press frame.

7. The device according to claim 6, which further comprises a grippable grip strip formed on a front edge of said withdrawable sheet depository.

8. The device according to claim 6, wherein said withdrawable sheet depository is formed of transparent material.

9. The device according to claim 6, including spring means for biasing said roll-up-type depository base of said sheet depository in a rolled-up stowing position, said base being unrollable and withdrawable against action of said spring means from the printing-press frame.

10. The device according to claim 3, wherein said sheet depository is formed with a plurality of telescopically retractable and extendable sections.

11. The device according to claim 10, which further comprises a grippable grip strip formed on a front edge of said withdrawable sheet depository.

12. The device according to claim 6, wherein said withdrawable sheet depository is formed of transparent material.

13. The device according to claim 1, including a plurality of blast-air nozzles disposed at said sheet depository for one of tautening and braking sheets in said sheet depository.

14. The device according to claim 1, which further comprises a programmable electronic control for automatic single-sheet removal, said electronic control being operatively connected to effect a delayed sheet release by said grippers, to govern driving elements for withdrawing said sheet depository, and said electronic control controlling means for driving and for timing a supply of suction air to said suction tapes.

15. The device according to claim 1, wherein said suction tape is a plurality of parallel, mutually spaced-apart suction tapes, said suction tapes receiving the sheets to be singled out from said grippers, accelerating the sheets, and subsequently decelerating the sheets over an extended distance towards said sheet depository.

16. The device according to claim 15, which further comprises a suction-tape drive drivingly connected with said suction tapes and having a control, said control accelerating said suction tapes up to a point when the sheet to be singled out is transferred from said grippers to said tapes, subsequently further accelerating said suction tapes beyond the point of sheet transfer, and initiating braking only after a delay.

* * * * *